US009163320B2

(12) United States Patent
Field et al.

(10) Patent No.: US 9,163,320 B2
(45) Date of Patent: Oct. 20, 2015

(54) ELECTROLYTIC CELL HAVING A TRANSITION DUCT OUTLET

(71) Applicant: Tennant Company, Minneapolis, MN (US)

(72) Inventors: Bruce F. Field, Golden Valley, MN (US); Charles W. O'Neil, Edina, MN (US)

(73) Assignee: TENNANT COMPANY, Minneapolis, MN (US)

( * ) Notice: Subject to any disclaimer, the term of this patent is extended or adjusted under 35 U.S.C. 154(b) by 243 days.

(21) Appl. No.: 13/836,251

(22) Filed: Mar. 15, 2013

(65) Prior Publication Data

US 2014/0262759 A1 Sep. 18, 2014

(51) Int. Cl.
*C25B 9/00* (2006.01)
*C25B 15/08* (2006.01)

(52) U.S. Cl.
CPC .. *C25B 15/08* (2013.01); *C25B 9/00* (2013.01)

(58) Field of Classification Search
CPC ..... C25B 15/08; C25B 9/00
USPC ..... 204/263, 275.1, 278.5
See application file for complete search history.

(56) References Cited

U.S. PATENT DOCUMENTS

| | | | | |
|---|---|---|---|---|
| 3,893,902 | A * | 7/1975 | Loftfield et al. | 205/350 |
| 4,097,358 | A * | 6/1978 | Wiseman | 204/270 |
| 4,134,805 | A | 1/1979 | Frohler et al. | |
| 4,422,919 | A | 12/1983 | Fabian et al. | |
| 5,531,865 | A | 7/1996 | Cole | |
| 5,911,870 | A * | 6/1999 | Hough | 205/701 |
| 7,695,607 | B2 * | 4/2010 | Polnicki et al. | 205/757 |
| 2004/0108222 | A1 | 6/2004 | Gattrell et al. | |
| 2009/0321251 | A1 * | 12/2009 | Rigby | 204/229.6 |
| 2012/0111720 | A1 | 5/2012 | Kuhnel | |
| 2012/0149789 | A1 * | 6/2012 | Greenbaum | 518/704 |

FOREIGN PATENT DOCUMENTS

| | | | |
|---|---|---|---|
| JP | H05209286 | A | 8/1993 |
| WO | 9521795 | A1 | 8/1995 |
| WO | 2009158589 | A2 | 12/2009 |

OTHER PUBLICATIONS

International Search Report and Written Opinion dated Jul. 9, 2014 for corresponding International Application No. PCT/US2014/026231, filed Mar. 13, 2014.

* cited by examiner

*Primary Examiner* — Nicholas A Smith
*Assistant Examiner* — Brian W Cohen
(74) *Attorney, Agent, or Firm* — David D. Brush; Westman, Champlin & Koehler, P.A.

(57) ABSTRACT

An electrolytic cell is provided. The cell includes a housing having a liquid inlet and a liquid outlet outlet, an anode and a cathode positioned within the housing and defining a reaction chamber therebetween, and a liquid flow path, from the liquid inlet to the liquid outlet, which passes through the reaction chamber. A transition duct is positioned at the liquid outlet and has a duct inlet, a duct outlet and a transition section along which internal side walls of the transition section converge along the liquid flow path to define a smooth transition from a first cross-sectional area to a second cross-sectional area of the transition duct. The first cross-sectional area is at least two times greater than the second cross sectional area.

16 Claims, 11 Drawing Sheets

ELECTROLYTIC CELL HAVING A TRANSITION DUCT OUTLET

BACKGROUND

The present disclosure relates electrolytic cells, and in particular, to an outlet from the housing containing the cell electrodes.

Electrolytic cells are used in a variety of different applications for changing one or more characteristics of a fluid. For example, electrolytic cells have been used in cleaning/sanitizing applications, medical industries and semiconductor manufacturing processes. Electrolytic cells have also been used in a variety of other applications and have had different configurations. For cleaning/sanitizing applications, electrolytic cells are used to create anolyte liquids, catholyte liquids, and/or combined anolyte and catholyte liquids, for example. Anolyte liquids containing hypochlorous acid (and other forms of free chlorine) have known sanitizing properties, and catholyte liquids have known cleaning properties. Also, electrolytic cells have been used to create liquids with charged nano-sized and micron-sized gas-phase bubbles, which are believed to improve the cleaning efficacy of the liquid by picking up dirt particles and preventing their re-deposition. The present disclosure relates to electrolytic cells used in these and other applications.

SUMMARY

An aspect of the present disclosure relates an electrolytic cell. The cell includes a housing having a liquid inlet and a liquid outlet outlet, an anode and a cathode positioned within the housing and defining a reaction chamber therebetween, and a liquid flow path, from the liquid inlet to the liquid outlet, which passes through the reaction chamber. A transition duct is positioned at the liquid outlet and has a duct inlet, a duct outlet and a transition section along which internal side walls of the transition section converge along the liquid flow path to define a smooth transition from a first cross-sectional area to a second cross-sectional area of the transition duct. The first cross-sectional area is at least two times greater than the second cross sectional area.

In a particular aspect, the internal side walls of the transition section converge along at least one plane that is parallel to a direction of fluid flow along the liquid flow path.

In a particular aspect, the internal side walls of the transition section have a minimum radius of curvature of 5 millimeters along the at least one plane that is parallel to the direction of fluid flow.

In a particular aspect, the internal side walls of the transition section are curvilinear in the at least one plane that is parallel to the direction of fluid flow.

In a particular aspect, the internal side walls of the transition section are rectilinear in the at least one plane that is parallel to the direction of fluid flow.

In a particular aspect, the ratio of the first cross-sectional area to the second cross-sectional area is between 5:1 and 20:1.

In a particular aspect, the transition section has a length of at least 20 millimeters and less than 100 millimeters along which the transition section transitions from the first cross-sectional area to the second cross-sectional area.

In a particular aspect, the transition section has a generally rectangular shape in at least one cross-sectional plane that is transverse to a direction of fluid flow along the liquid flow path.

In a particular aspect, the transition section has a funnel shape along at least one plane that is parallel to a direction of fluid flow along the liquid flow path.

In a particular aspect, the transition section is conical.

In a particular aspect, the transition duct has an internal channel that transitions from a generally rectangular shape at a location of the first cross-sectional area to an oval or elliptical shape at a location of the second cross-sectional area.

In a particular aspect, the liquid flow path through the transition duct has a first direction at the duct inlet and a second direction at the duct outlet, which is perpendicular to the first direction.

In a particular aspect, the transition duct is physically attached to the housing or is fabricated as a single, continuous piece of material with a portion of the housing.

Another aspect of the present disclosure relates to an electrolytic cell, which includes a housing with a liquid inlet and a liquid outlet outlet, an anode and a cathode positioned within the housing and defining a reaction chamber therebetween, and a liquid flow path, from the liquid inlet to the liquid outlet, which passes through the reaction chamber. A transition duct is positioned at the liquid outlet and has a duct inlet, a duct outlet and a funnel-shaped transition section along which internal side walls of the transition section converge in at least one plane that is parallel to a direction of fluid flow along the liquid flow path. The transition section defines a smooth transition from a first cross-sectional area to a second cross-sectional area of the transition duct, wherein a ratio of the first cross-sectional area to the second cross sectional area is in a range of 2:1 and 20:1 and the transition section has a length of at least 20 millimeters and less than 100 millimeters.

DETAILED DESCRIPTION

Figure 1:
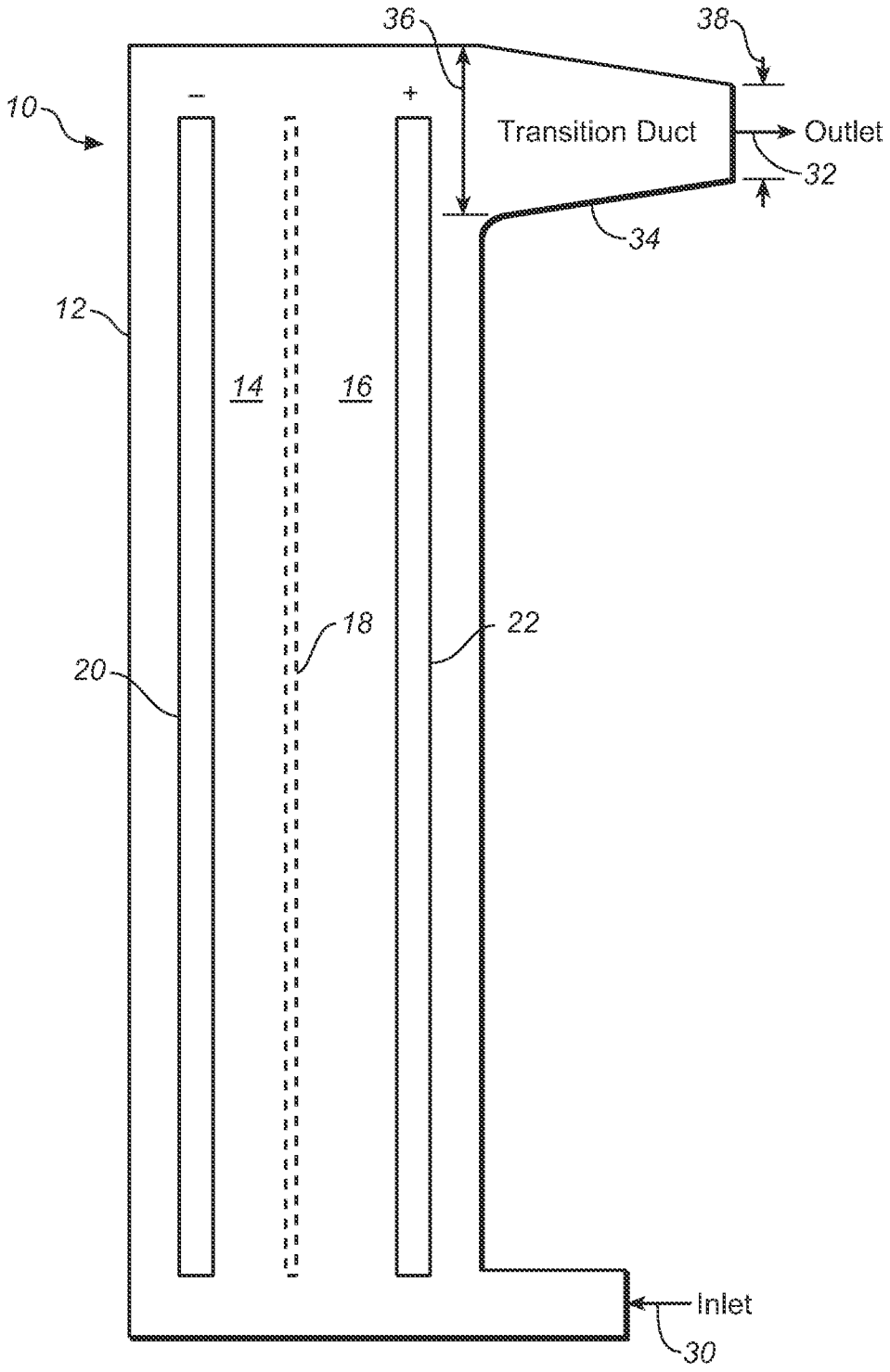
FIG. 1 is a schematic illustration of an electrolytic cell according to an exemplary aspect of the present disclosure.

The present disclosure is directed to an electrolytic cell for generating one or more electrolytic output streams from a feed liquid using electrolysis. The cell can be used in a variety of different applications, such as cleaning or sanitizing applications, medical applications, and semiconductor manufacturing processes. The cell may be configured within a stationary system configured to dispense an electrochemically-activated liquid to an application site, to fill portable containers or mobile cleaning/sanitizing units (e.g., such as mobile floor cleaners sold by Tennant Company of Golden Valley, Minn.), or may be configured as an onboard electrolytic cell within in a mobile cleaning unit, for example.

During the electrochemical process, undesirable deposits known as "scale" may form within the electrolytic cell. For example, scale may precipitate on one or more of the cell electrodes. Since precipitates such as calcium carbonate are electrically insulating, the scale deposits increase the electrical resistance across the cell, thereby lowering efficiency of electrolysis. In addition, scale deposits can increase the flow resistance through the cell and through the outlet(s) from the cell. As a result, the electrochemical process can become less efficient. A number of methods and devices have been developed to deal with these problems. For example, control circuits have been designed for periodically reversing the voltage potential applied across the cell electrodes to repel and discharge scale deposits on the electrode surfaces. Further, the electrode and housing materials have been modified to help reduce scale build-up within the cell.

In an exemplary embodiment of the present disclosure, the cell housing is modified to reduce the tendency of scale from precipitating on the interior surfaces of the housing containing the cell electrodes, and more specifically at or along the outlet port(s) of the cell, for example.

It is believed that scale may precipitate on the surfaces of the housing when the velocity of the liquid flowing through the housing or outlet is slow, such as when caused by turbulent flow due to sharp transitions in the cross-sectional area of the flow path. Also, once scale begins to deposit onto the interior surfaces of the housing, this further increases the turbulence and enables even more scale to deposit onto the housing surfaces. Scale deposits may clog the flow path, particularly at flow restrictions such as at outlet ports where the cross-sectional area of the flow path is constricted. Often, electrolytic cells have small inlet and outlet ports that connect to conduit for feeding liquid to and from the cell. An aspect of the present disclosure is directed to maintaining laminar flow through the transition between the reaction chambers containing the cell electrodes and the outlet port(s) of the cell. This is accomplished, for example, by maintaining a smooth transition between the relatively large cross-sectional area of an outlet from the cell reaction chambers and a relatively small cross-sectional area of the conduit connected to the outlet port(s) of the cell.

FIG. 1 is a schematic diagram of an electrolytic cell 10 according to an exemplary aspect of the present disclosure. Electrolytic cell 10 includes a housing 12, such as a container or channel, a cathode chamber 14 and an anode chamber 16. In one example, a barrier 18 at least partially or completely separates the cathode chamber 14 from the anode chamber 16. In another example, there is no barrier 18 between cathode 20 and the anode 22 such that the cathode chamber 14 and the anode chamber 16 are combined. The electrolytic cell 10 further includes a cathode 20 located in the cathode chamber 14 and an anode 22 located in the anode chamber 16. In the example shown in FIG. 1, cell 10 has one cathode 20 and one anode 22. In a further exemplary embodiment, cell 10 has five electrodes, including two anodes 22 interleaved with three cathodes 20 (or two cathodes interleaved with three anodes), and has no barriers between the cathodes and anodes. Cell 10 further includes one or more inlets 30 for supplying a feed liquid to the cathode chamber 14 and the anode chamber 16 (or combined chambers) and one or more outlets 32 for receiving electrochemically-enhanced liquid from the cathode chamber 14, the anode chamber 16 and/or the combined chambers.

Electrolytic cell 10 further includes a transition duct 34 that reduces turbulence in the flow of liquid through a transition between the reaction chambers and the outlet port(s) of the cell. Transition duct 34 maintains a smooth transition between a relatively large cross-sectional area 36 of an inlet-end of the transition duct, at the outlet from the cell reaction chambers, and a relatively small cross-sectional area 38 at an outlet-end of the transition duct, where outlet 32 connects to a conduit (not shown) for feeding the electrochemically-enhanced liquid to an application site, a storage container or dispenser, for example. In embodiments having separate outlets from the cathode chamber(s) 14 and the anode chamber (s) 16, a transition duct may be positioned at the outlet of each chamber. Transition duct 34 can have any suitable cross-sectional shape in a direction transverse to fluid flow, such as a rectangular, a circular or an oval shape. Transition duct can also have any suitable orientation relative to housing 12 or the orientation of electrodes 20 and 22. In the example shown in FIG. 1, transition duct has an orientation such that fluid flow through the duct is transverse to the direction of fluid flow between electrodes 20 and 22. In the embodiment discussed below with respect to FIG. 2, the transition duct has an orientation such that fluid flow through a section of the duct is parallel to the direction of fluid flow between electrodes 20 and 22. The transition duct 34 may be located, for example, along a side of cell 10, as shown in FIG. 1 or on an end of the cell, such as coaxial with the cell electrodes, for example.

Electrolytic cell 10 can have any number of cathodes and anodes and can have any suitable shape, construction or arrangement. For example, the electrodes can be flat plates, coaxial plates, rods, or combinations thereof. The electrodes can be made from any suitable material, for example stainless steel, a conductive polymer, titanium and/or platinum, or other material. One or more of the electrodes may (or may not) be coated with a material, such as platinum, iridium and/or ruthenium oxide. In one embodiment, each electrode plate comprises platinum-coated titanium. The particular electrode material may be selected as a function of the desired chemical species generated during the electrolysis process. Each electrode can have, for example, a solid construction or can have one or more apertures, such as a mesh. Multiple cells 10 and/or electrodes can be coupled in series or in parallel with one another, for example.

In a particular example, electrolytic cell 10 has five parallel plate electrodes, including three cathode electrodes interleaved with two anode electrodes (or three anodes interleaved with two cathodes), each separated from one another by a suitable gap that lacks a barrier 18. Each electrode in this example is formed of a solid titanium plate that is coated with platinum.

In embodiments that include a barrier 18, the barrier may include a membrane (e.g., an ion exchange membrane) or other diaphragm or separator that separates cathode chamber 14 and anode chamber 16. In embodiments in which barrier 18 is a membrane, barrier 18 can include a cation exchange membrane (i.e., a proton exchange membrane) or an anion exchange membrane. In some embodiments, barrier 18 includes a material that does not act as a selective ion exchange membrane, but maintains general separation of the anode and cathode compartments. In particular examples, the barrier material may include a hydrophilic microporous material that conducts current between the anode and cathode electrodes and facilitates production of bubbles in the output liquid. Exemplary materials for such a barrier include polypropylene, polyester, nylon, PEEK mesh, Polytetrafluoroethylene (PTFE), polyvinylidene difluoride and thermoplastic mesh, for example.

To produce an electrochemically-enhanced liquid, the cathode and anode chambers of electrolytic cell 10 are fed with a liquid, such as water or a mixture of water and a salt solution (e.g., $H_2O$ and sodium chloride or potassium chloride), through inlet 30, and a voltage potential difference is applied between the cathode electrode(s) 20 and the anode electrode(s) 22 to induce an electrical current between the electrodes and through the liquid (across barrier 18, if present).

Figure 2:
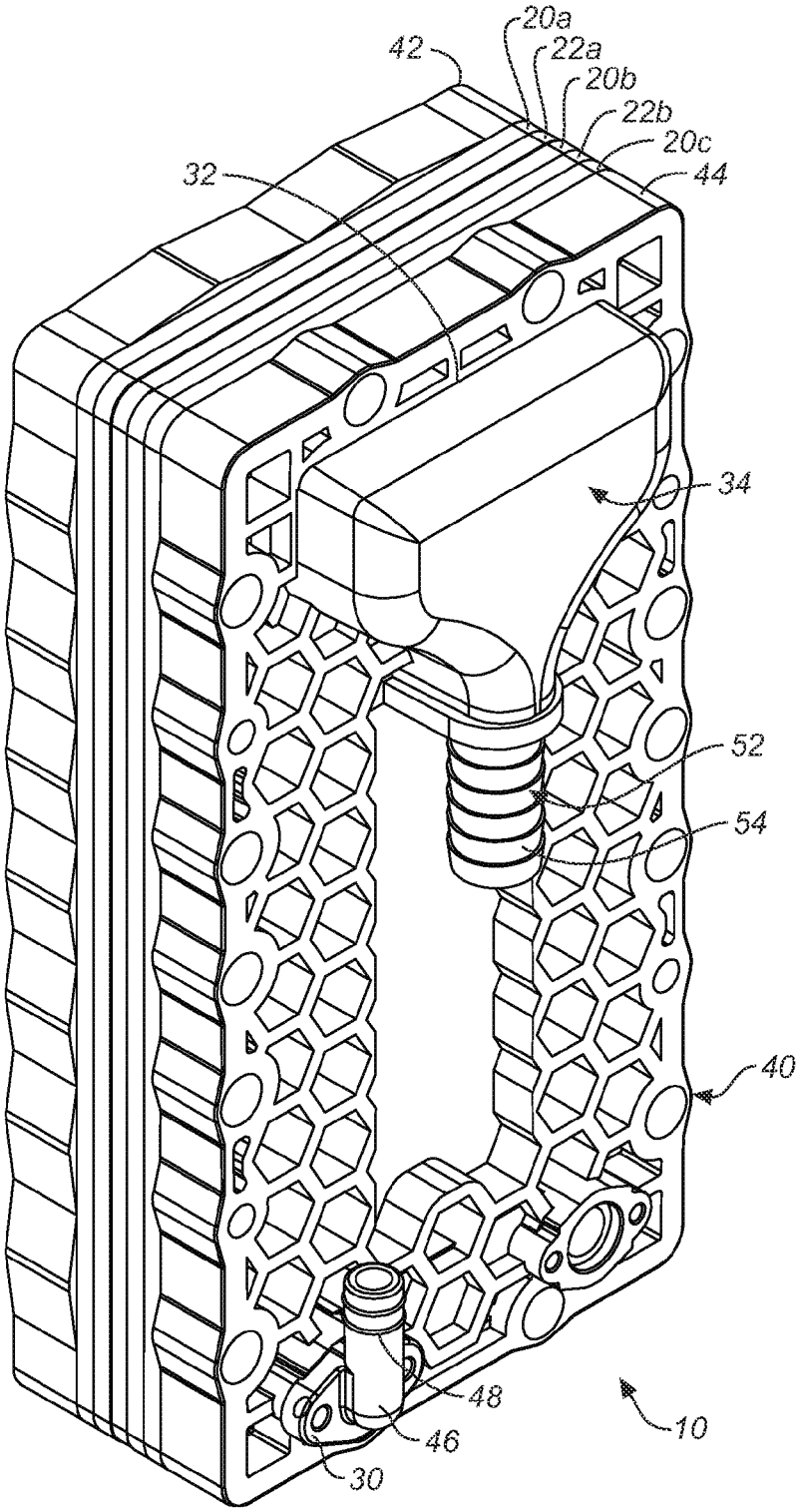
FIG. 2 is a perspective view of an exemplary electrolytic cell having a transition duct according to one embodiment of the present disclosure having five electrodes.
Figure 3:
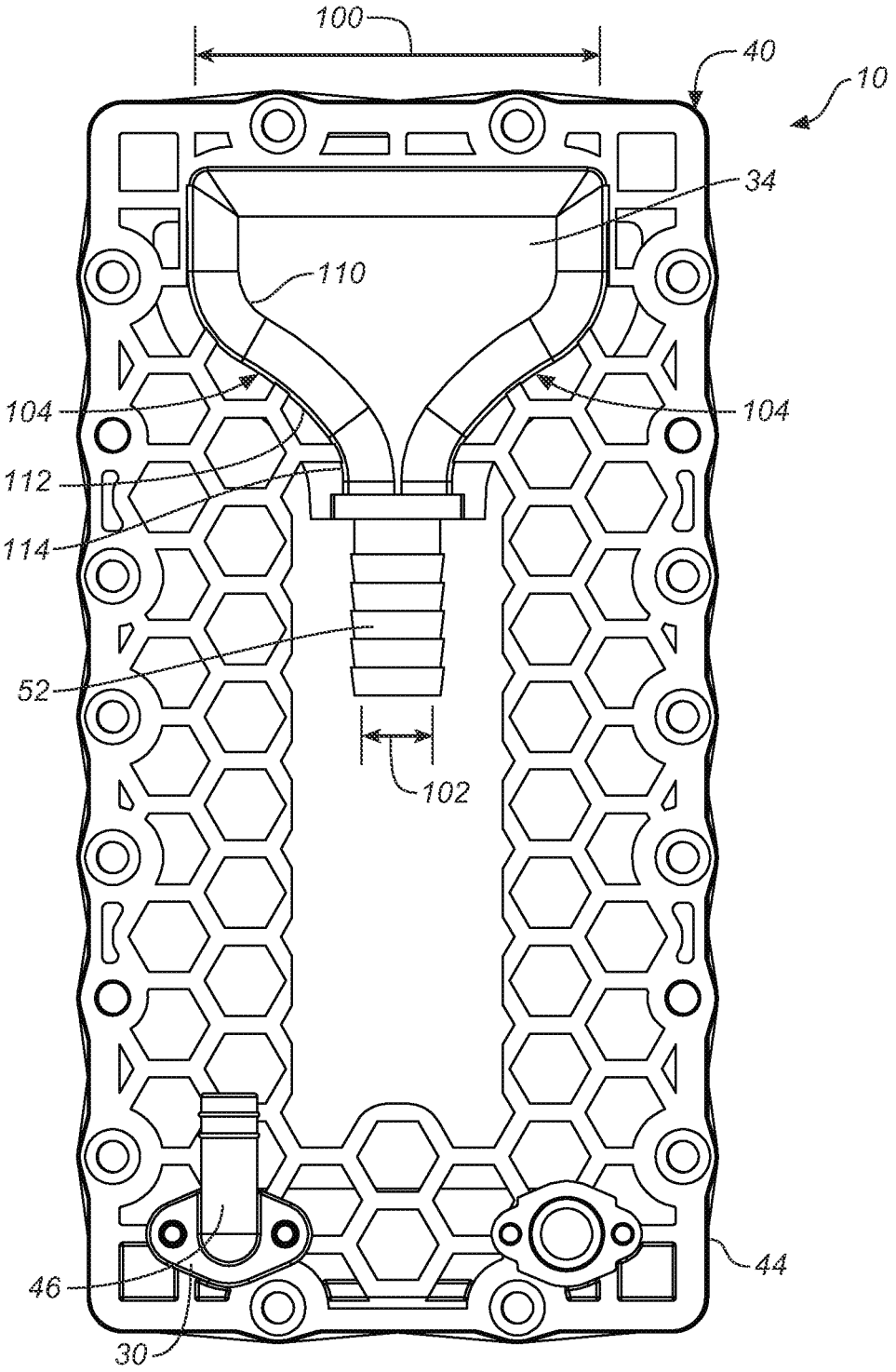
FIG. 3 is a first side elevation view of the electrolytic cell shown in FIG. 2.
Figure 4:
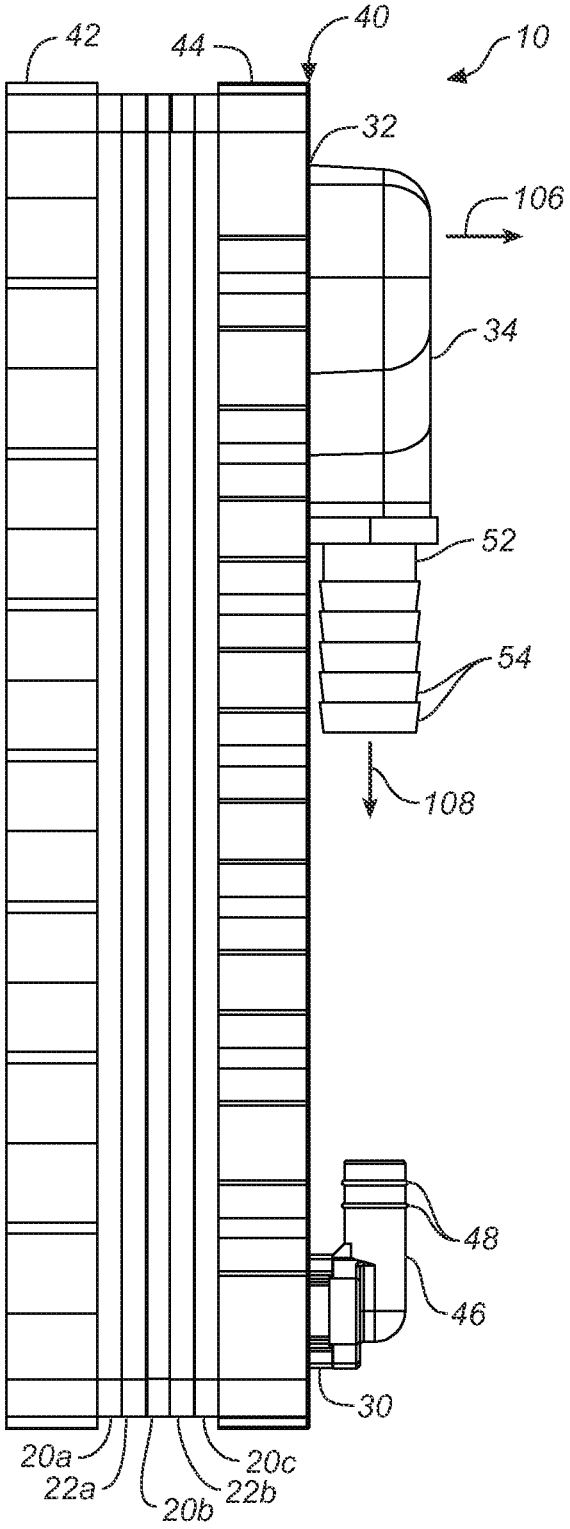
FIG. 4 is a second side elevation view of the electrolytic cell shown in FIG. 2.

FIG. 2 illustrates an example of electrolytic cell 10 according to one particular embodiment of the present disclosure having five electrodes, as mentioned above. FIG. 3 is a first side elevation view of cell 10, and FIG. 4 is a second side elevation view of cell 10. Cell 10 includes a main housing 40 having a sandwich construction in which three cathode electrode places 20*a*, 20*b* and 20*c* and two interleaved anode electrode plates 22*a* and 22*b* are held between two end plates 42 and 44. The plates may be held together by screws, bolts, an adhesive or any other suitable attachment method.

End plate 44 includes the inlet 30 and a tube adapter 46. Tube adapter 46 is connected to the inlet 30 (or formed integrally therewith) and is configured to connect to a conduit, such as a flexible tube, for receiving a supply of feed liquid. In this example, tube adapter 46 is a male type adapter configured to the flexible tube by a friction fit. For example, the outer diameter surface of tube adapter 46 may include one or more annular ribs or flanges 48, which assist in retaining the end of a flexible tube or other conduit (not shown) onto the end of tube adapter 46. Other types of adapters can be used to connect a conduit to the inlet 30. The inlet 30 is fluidically coupled to gaps between the cathode 20*a*-20*c* and the anode electrodes 22*a*-22*b* at an inlet end of the cell 10.

In this example, end plate 44 also includes the outlet 32 and transition duct 34. A tube adapter 52 is coupled to the output of transition duct 34. The outlet 32 is fluidically coupled to the gaps between the cathode electrodes 20*a*-20*c* and the anode electrodes 22*a*-22*b* at an outlet end of the cell 10, which is opposite to the inlet end of the cell, for example. In one example, transition duct 34 is physically connected to end plate 44 (or another component part of the housing). For example, transition duct 34 may be a component part distinct from end plate 44 and physically attached directly to end plate 44 or may be fabricated with end plate 44 (or another part of the cell housing) as a single, continuous piece of material. In the example shown in FIG. 2, transition duct 34 is formed integrally with the material of end plate 44. As mentioned previously, transition duct 34 provides a smooth transition from a relatively large cross-sectional area of outlet 32 and a relatively small cross-sectional area of tube adapter 52. In this example, tube adapter 52 is a male type adapter configured to connect to a flexible tube by a friction fit. However, other types of adapters can be used to connect a conduit to transition duct 34. Similarly, tube adapter 52 may be a component part distinct from transition duct 34 or fabricated with transition duct 34 as a single, continuous piece of material. In the example shown, tube adapter 52 is a distinct part having a recessed shoulder with an outer diameter surface that frictionally engages an inner diameter surface of transition duct 34. The outer diameter surface of tube adapter 52 has one or more annular ribs or flanges 54, which assist in retaining the end of a tube (not shown) onto the adapter.

Figure 5:
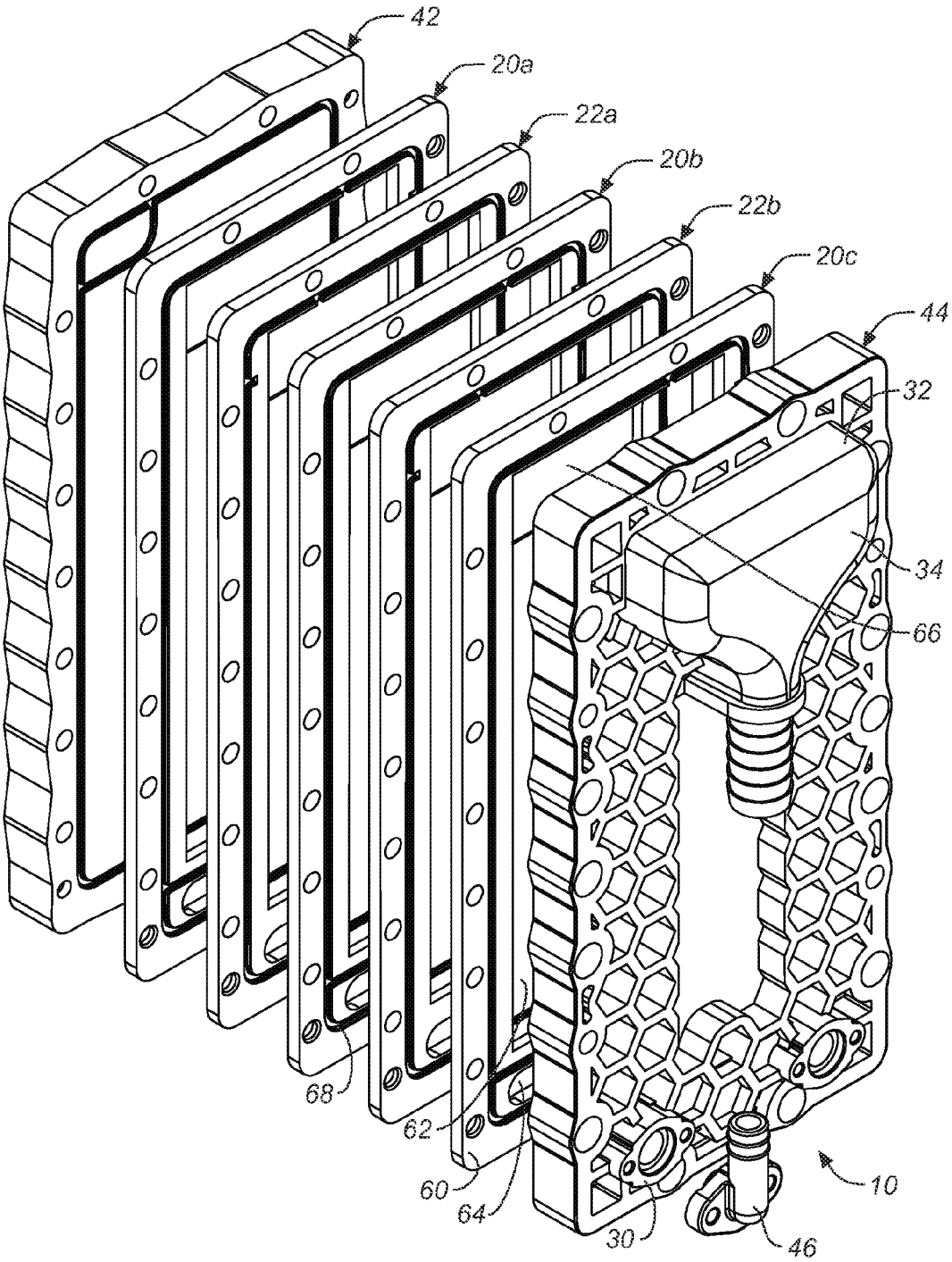
FIG. 5 is an exploded, perspective view of the electrolytic cell shown in FIG. 2, which illustrates cathode and anode electrode plates in more detail.

FIG. 5 is an exploded, perspective view of electrolytic cell 10, which illustrates the cathode and anode electrode plates 20*a*, 20*b*, 20*c* and 22*a*, 22*b* in more detail. In this example, each electrode plate 20, 22 has a peripheral frame 60 of non-electrically conductive material, which supports a respective electrically conductive anode or cathode electrode 62. Each plate 20, 22 further includes an inlet aperture 64, near inlet 30, and an outlet aperture 66, near outlet 32 for passing liquid transversely through the frames and into and out of the gaps between the electrodes 62. The frames 60 are configured to provide suitable gaps between the electrodes 62 when sandwiched between end plates 42 and 44. Each frame and/or end plate may include one or more O-rings 68 to enhance the seal between adjacent plates. Inlet apertures 64 together provide a fluid channel from inlet 30 to an inlet end of the gaps between the electrodes 62. Similarly, outlet apertures 66 together provide a fluid channel from an outlet end of the gaps between the electrodes 62 to the outlet 32. When electrode plates 20, 22 are sandwiched between end plates 42 and 44, the plates form a plurality of reaction chambers between the electrodes, which extend from the inlet end to the outlet end of the cell 10.

Figure 6:
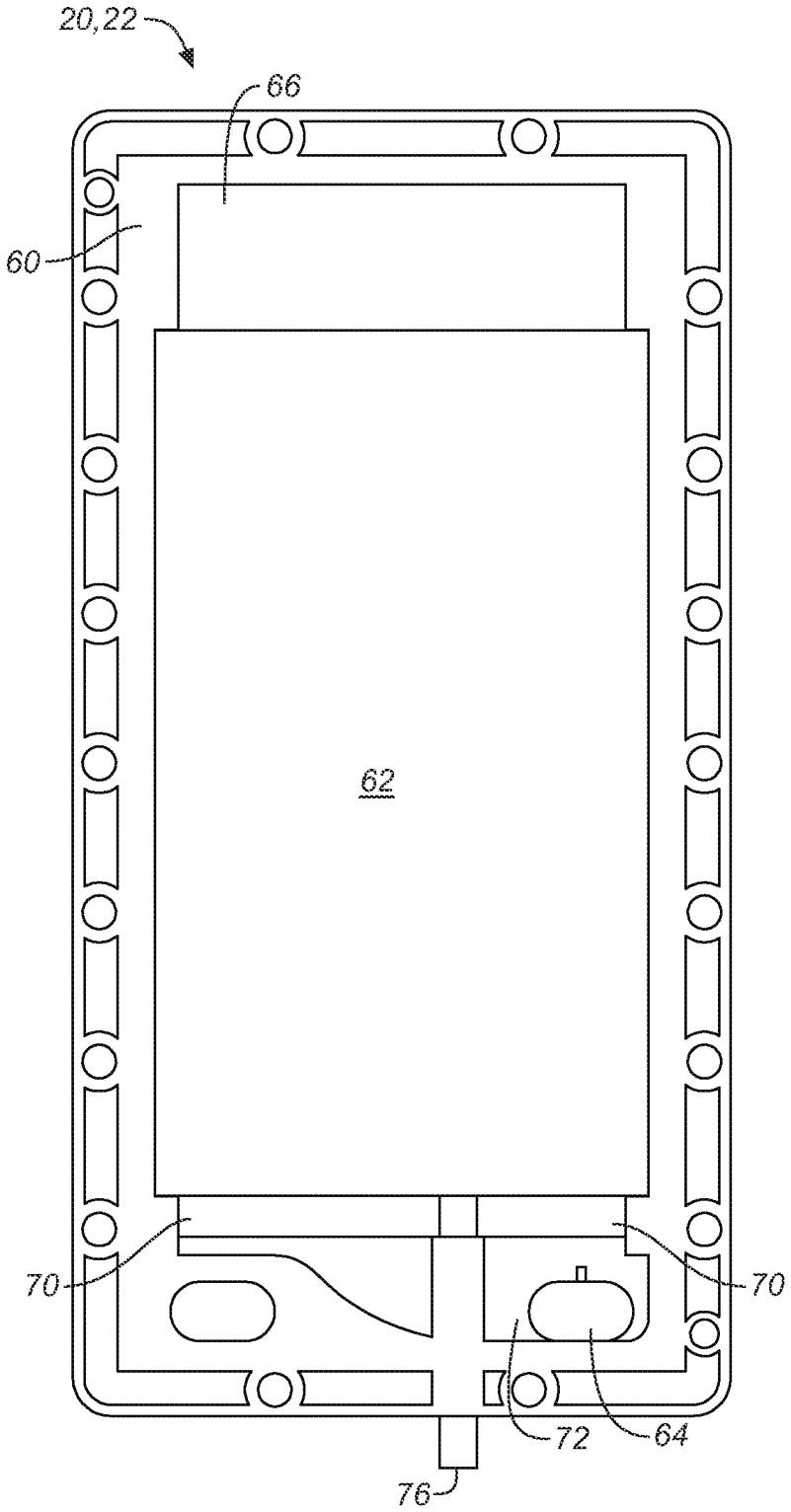
FIG. 6 is a plan view of one of the anode or cathode electrode plates, according to an exemplary embodiment.

FIG. 6 is a plan view of one of the anode or cathode electrode plates 20, 22. As described above, each electrode plate 20, 22 has a peripheral frame 60, which supports a respective conductive anode or cathode electrode 62. Each plate 20, 22 further includes an inlet aperture 64, near inlet 30, and an outlet aperture 66, near outlet 32 for passing liquid through the frames and into and out of the gaps between the electrodes 62. There is also an aperture 70 in each plate 20, 22 at the inlet end of the plate, between an edge of the electrode 62 and an opposing edge of the frame material 60 to encourage liquid flow among and between the adjacent electrodes 62. Each frame 60 also includes a partial recess 72 providing a channel for liquid to pass from inlet aperture 64 to aperture 70 and the gaps between the electrodes. At the outlet end, aperture 66 is positioned between an edge of the electrode 62 and an opposing edge of the frame material 60. The cross-sectional area of aperture 66 is relatively large, as compared to the cross-sectional areas of apertures 64 and 70, to encourage unimpeded liquid flow from the reaction chambers to the outlet 32 in order to reduce the build up of scale along the outlet flow path.

Each electrode plate 20, 22 further includes an electrically-conductive terminal 76 extending from a perimeter of the frame 60 and electrically connected to the respective electrode 62. A control circuit (not shown) can then be connected to the various terminals 72 through electrical leads for applying a voltage potential between the electrodes 62.

Figure 7:
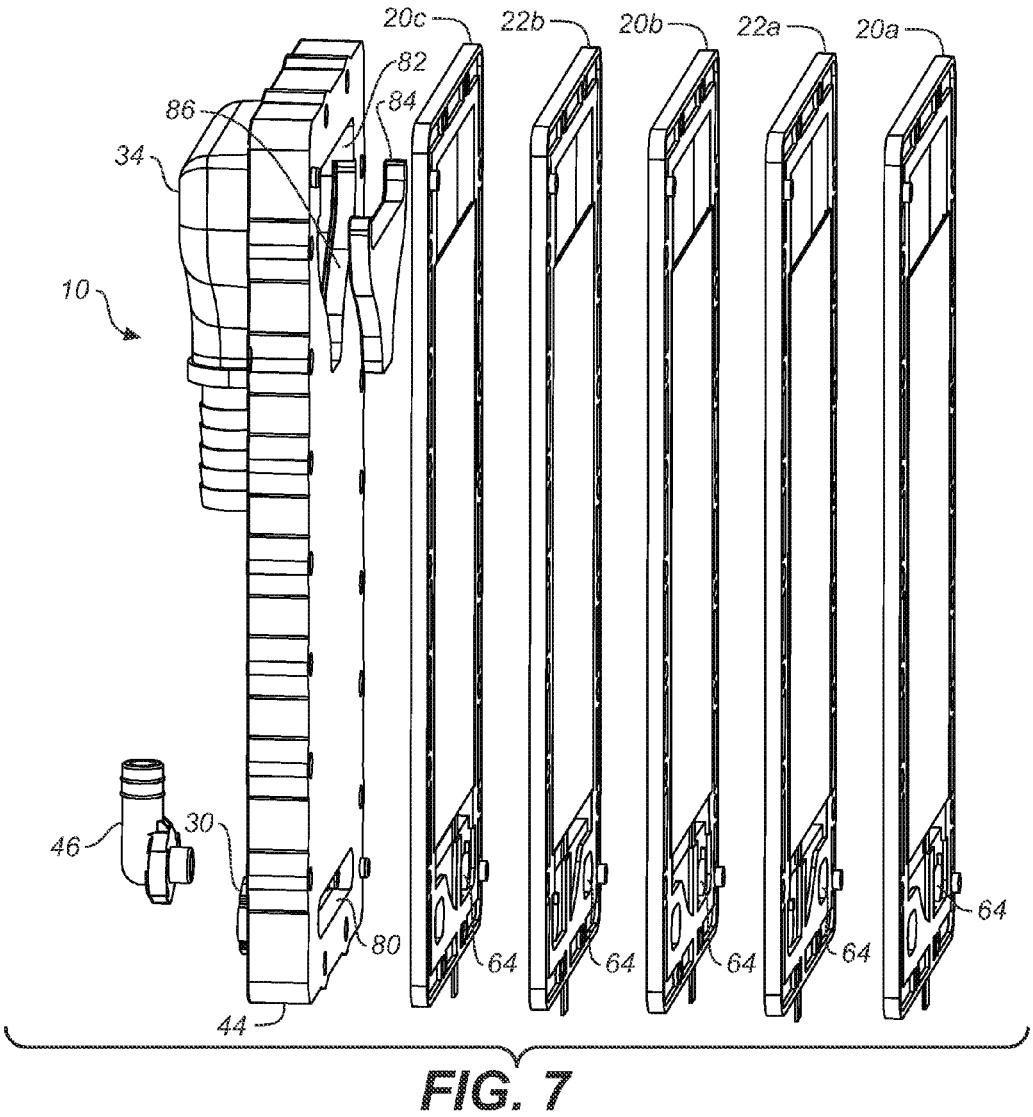
FIG. 7 is an exploded, perspective view of the electrode plates an end plate of the electrolytic cell, as viewed from a vantage point beneath the end plate.

FIG. 7 is an exploded, perspective view of electrode plates 20, 22 and end plate 44, as viewed from a vantage point beneath end plate 44. In this example, end plate 44 includes a generally a rounded rectangular (or oval, for example) inlet recess 80, which is fluidically coupled to a generally circular inlet 30 and provides a channel through which fluid can pass, from inlet 30 to the inlet apertures 64 in plates 20, 22.

At the outlet end of cell 10, end plate 44 includes a generally rounded rectangular (or oval, for 4 example) outlet aperture 82, which defines the outlet 30 provides a channel through which fluid can pass from the outlet apertures 66 in plates 20, 22 to the transition duct 34. The edges of aperture 82 are defined by the edges of a recess 86 formed in end plate 44 and an edge of insert 84. Insert 84 has a peripheral shape and thickness that matches the peripheral shape and thickness of recess 86, except at an opening that defines outlet aperture 82. Insert 84 and recess 86 are provided for manufacturing purposes. In one exemplary embodiment in which transition duct is molded or otherwise fabricated as a single continuous piece of material with end plate 44, recess 86 permits access to the interior of transition duct 34, so that the interior of the duct can be formed by a mold. After fabrication, insert 84 can then be glued or otherwise adhered within the recess 86 to close-off the opening formed by the recess (except for the desired outlet aperture 82). In an exemplary embodiment in which transition duct 34 is fabricated as a separate, distinct piece of material from end plate 44, the transition duct can be molded or otherwise fabricated without having to create recess 86 in end plate 44. In this embodiment, end plate 44 is simply fabricated with a rounded rectangular outlet aperture 82 (or an aperture with any other desired cross-sectional shape.

Figure 8:
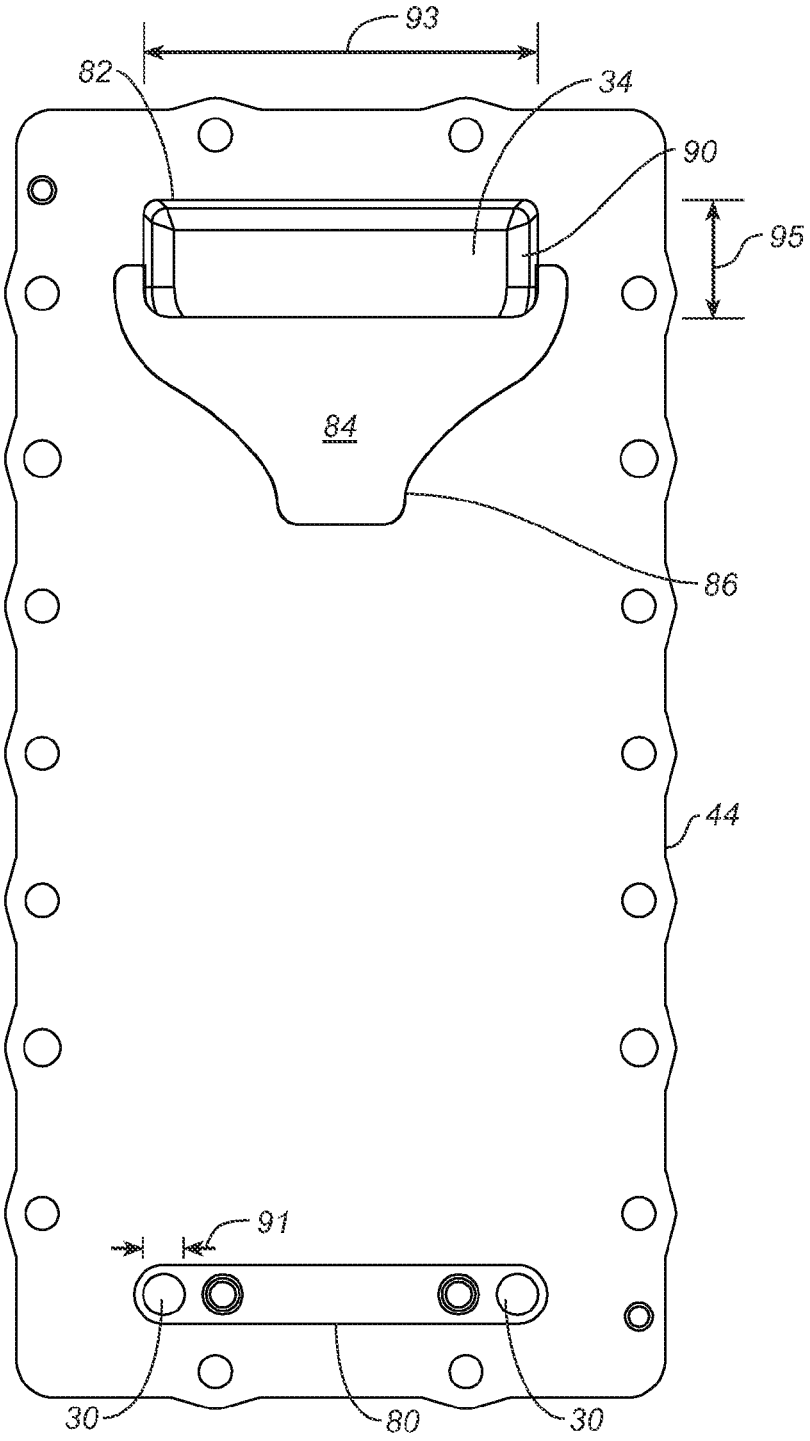
FIG. 8 is a bottom plan view of the end plate shown in FIG. 7 according to an exemplary embodiment.

FIG. 8 is a bottom plan view of end plate 44, after insert 84 has been glued or otherwise secured into recess 86. Once insert 84 is secured into recess 86, outlet 82 has a generally rounded rectangular shape in this example. On the inlet end of end plate 44, one or more circular openings are formed within inlet recess 80, which define inlet(s) 30. One or more of these inlet(s) 30 are connected to a tube adapter, as shown in FIG. 2. Unused inlets 30 can be closed-off. In one example, end plate 44 has two inlets 30 at each end of aperture 80, each of which mates with a corresponding one of two apertures 64 in electrode plates 20, 22. This permits the electrode plates to be mounted together in either of two orientations, if desired.

In a particular, non-limiting example, inlet 30 has a diameter 91 of 5.6 millimeters and has a cross-sectional area of about 24.6 square-millimeters; and outlet aperture 82 has a length 93 of 53.46 millimeters, a width 95 of 16 millimeters and a cross-sectional area of 848.4 square-millimeters, taking into account the radiused corners of the rounded-rectangular shape. So in this example, the area of outlet 32 is much greater than that of inlet 30.

The interior surface of transition duct 34 is visible through outlet aperture 82 in FIG. 8. The shape and cross-sectional area of transition duct 34 are selected to avoid sharp transitions and resulting turbulence in the output flow. For example, the inlet end of transition duct 34 has generally a rectangular shape with rounded corners. Also, the internal corners of duct 34 are rounded, as shown by radius lines 90, particularly at locations at which the flow direction through the duct changes.

Figure 9:
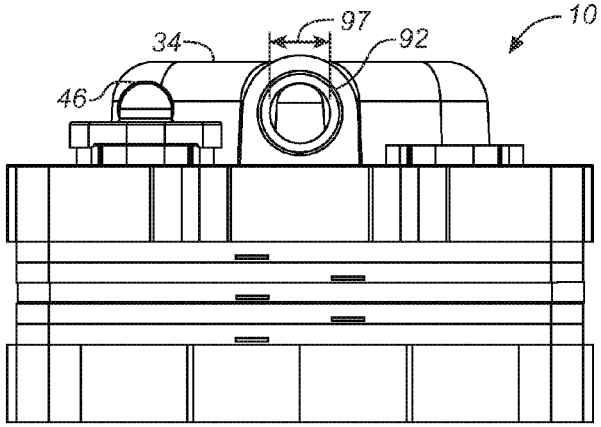
FIG. 9 is an end elevation view of the electrolytic cell shown in FIG. 2, which illustrates a lumen through a transition duct, according to an exemplary embodiment.

FIG. 9 is an end elevation view of electrolytic cell, which illustrates transition duct 34, with tube adapter 52 (shown in FIG. 1) removed. The outlet end of transition duct 34 has aperture 92, which in this particular example has a circular cross-section with a diameter 97 of 13.2 millimeters and a cross-sectional area of 136.8 square millimeters. This cross-sectional area is selected, for example, to match roughly the internal diameter of the tube adapter 52 and the diameter of the flexible tubing that attached to the end of the adapter. As shown in FIGS. 2-9, transition duct 34 has a transition section along which the internal side walls of transition duct 34 gradually converge to provide a smooth transition from a first cross-sectional area of 848.4 square millimeters at an inlet end of the duct to a second cross-sectional area of 136.8 square millimeters at an outlet end of the duct, corresponding to a ratio of inlet area to outlet area of 6.2:1. This smooth transition in cross-sectional area helps prevent scale build-up caused by more sharp transitions and their resulting turbulence and scale collection points. Thus, transition duct 34 substantially eliminates a flow restriction between the flow path through the reaction chambers and the outlet of the cell, where the cell connects to the output tubing. The ratio of the first cross-sectional area near the inlet end of transition duct 34 to the second cross-sectional area near the outlet end of transition duct 34 may be at least 2:1, at least 5:1, at least 10:1, at least 15:1, at least 20:1, between 2:1 and 10:1, between 5:1 and 10:1, and between 2:1 and 20:1, for example.

The gradual change in cross-sectional area in this example can be seen clearly in FIG. 3. The inlet-end of transition duct 34 has a relatively large width 100 at outlet 32, defined by aperture 82 (shown in FIG. 8). The outlet-end of transition duct has a substantially smaller width 102 defined by the internal diameter of the channel through tube adapter 52. In one embodiment, there is no step change or sharp transition between the cross-sectional area at the outlet of transition duct 34 and the inlet of tube adapter 52.

In the present example, the ratio of inlet width 100 to outlet diameter 102 of transition duct 34 is 4.3:1 (i.e., 53.46 mm/13.2 mm to 1). The transition between inlet width 100 to outlet diameter 102 is defined by gradually converging, curvilinear sidewalls 104 along the liquid flow path in the direction of fluid flow. Side walls 104 may be rectilinear in another embodiment. The transition section along which the side walls converge may extend from the inlet end of the duct 34 (duct inlet) to the outlet end of the duct (duct outlet) or may extend only along a transition section positioned between the duct inlet and the duct outlet, where the cross-sectional area of duct 34 transitions from the first cross-sectional area to the second cross-sectional area. In one exemplary embodiment, the transition section has a length of at least 20 millimeters and less than 100 millimeters. The transition section can have other lengths in other embodiments.

In the example shown in FIG. 3, the side walls 104 provide transition duct 34 with a smooth transition in cross-sectional area, from the inlet end to the outlet end of the duct along at least one plane that is parallel to the direction of fluid flow through the duct (e.g., a plane parallel to the electrode plates). In this example, transition duct 34 has a cross-section, taken along a plane parallel to the electrode plates, that has a funnel shape, for example, whereby the side walls 104 gradually converge along a generally S-curve. This curve has a first radius of curvature 110 of 11 millimeters in a direction internal to the duct, followed by a radius of curvature 112 of 44 millimeters in an opposite direction, followed by a radius of curvature 114 of 13 millimeters in the same direction as radius 112. In one example opposing side walls of the transition section have a minimum radius of curvature in a direction internal to the duct of 5 millimeters (which includes a straight line) in at least one plane parallel to the direction of fluid flow at which the cross-sectional area transitions smoothly from the first cross-sectional area to the second cross-sectional area (along the direction of convergence of the water flow). In another example the minimum radius is at least 10 millimeters. The smooth convergence of the side walls maintains substantially laminar flow of the output liquid as the cross-sectional area of the transition duct 34 gradually decreases toward the tube adapter 52.

Duct 34 has a generally rectangular cross-sectional shape (but with smooth, rounded internal corners) along at least one cross-sectional plane that is transverse to fluid flow and along least one cross-sectional plane that is perpendicular to the electrode plates, along a longitudinal axis of the cell 10, for example. In another embodiment, the two opposing internal side walls of duct 34 may also converge smoothly along the plane perpendicular to the electrode plates, along the longitudinal axis of the cell 10. The term "generally rectangular" means a rectangular shape that has flat side edges but may have sharp or curved corners between the side edges. As can be seen in FIG. 2, transition duct 34 also transitions smoothly from a generally rectangular shape at its inlet end to a generally oval or elliptical shape at its outlet end, where the term "elliptical" includes a circle.

As shown in the side elevation view of FIG. 4, transition duct 34 provides a smooth change in flow direction from a first direction 106 to a second direction 108, which is orthogonal to direction 106 for example. During operation, if cell 10 has an orientation similar to that shown in FIGS. 2-4, where outlet 32 is positioned vertically above inlet 30, then the liquid passing through the cell 10 will be pushed upward and out outlet 30, then fall into the funnel formed by transition duct 34, somewhat like a waterfall. Other orientations can also be used.

In another embodiment, transition duct 34 does not impart a flow direction change, but maintains a common flow direction from the inlet of the duct to the outlet of the duct. Also, the transition duct can have a variety of different cross-sectional shapes in different embodiments. For example, the duct may maintain a circular or oval cross-section along a plane transverse to the direction of fluid flow, more like a traditional funnel with a wide, conical mouth at the inlet, which transitions smoothly to a narrower stem at the outlet. The duct could extend perpendicularly from the end plate 40 of cell 10, for example. In another example, cell 10 has cylindrical shape with coaxial electrodes. In this example, the transition duct may be coaxial with the electrodes and extend from an end of the cell along a longitudinal axis of the cell, or may extend from a side wall of the cell similar to the embodiments of FIGS. 2-9, for example.

Figure 10:
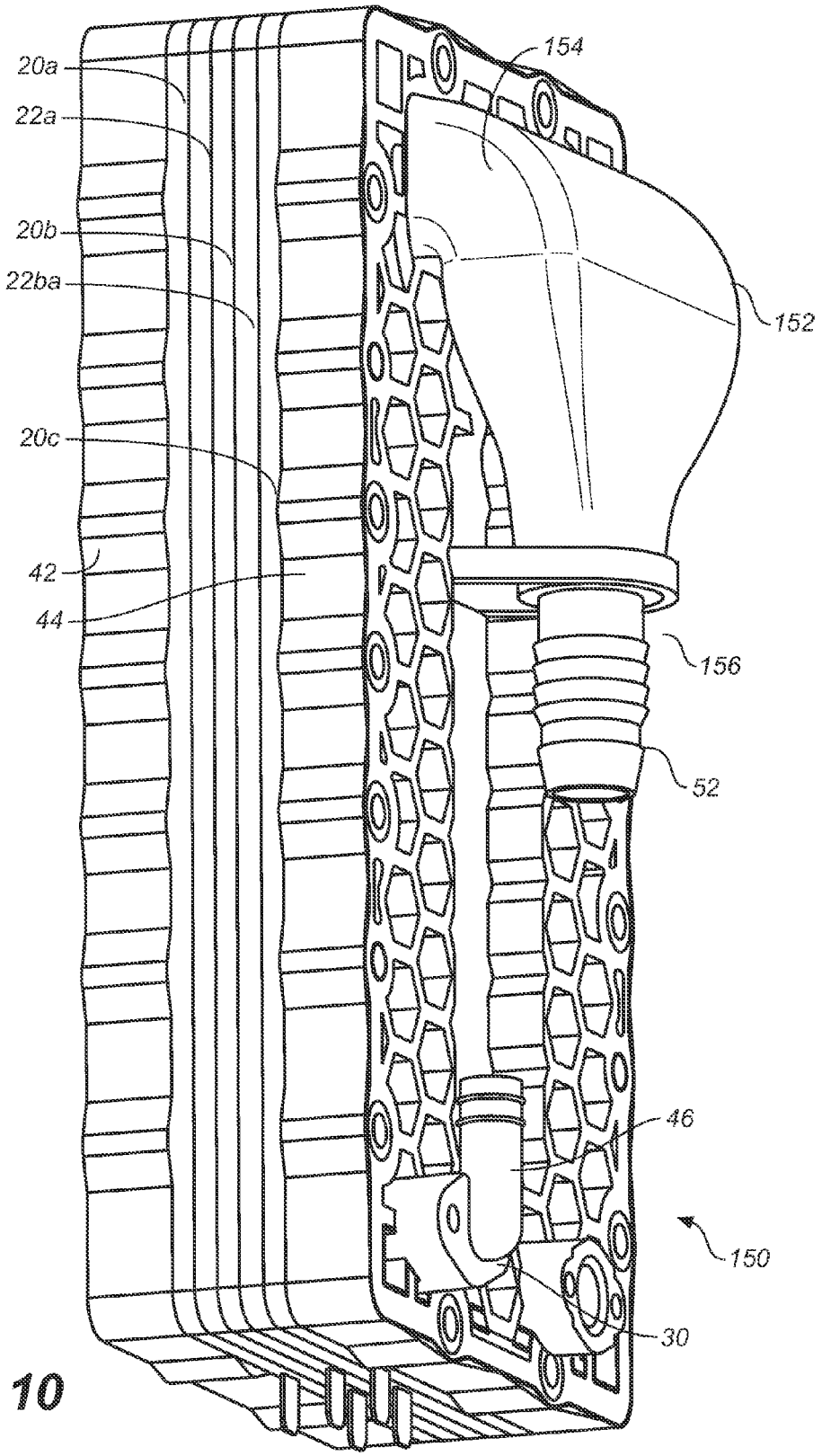
FIG. 10 is a perspective view of an electrolytic cell according to a further embodiment of the present disclosure.

FIG. 10 is a perspective view of an electrolytic cell 150 according to a further embodiment of the present disclosure. The same reference numerals are used for the same or similar elements. In this example, transition duct 152 is similar to transition duct 34, but is fabricated as a distinct component part from end plate 44. Transition duct 152 has an inlet 154 that is connected (such as with an adhesive) to outlet aperture 82 (shown in the embodiment of FIG. 8) of end plate 44.

Figure 12:
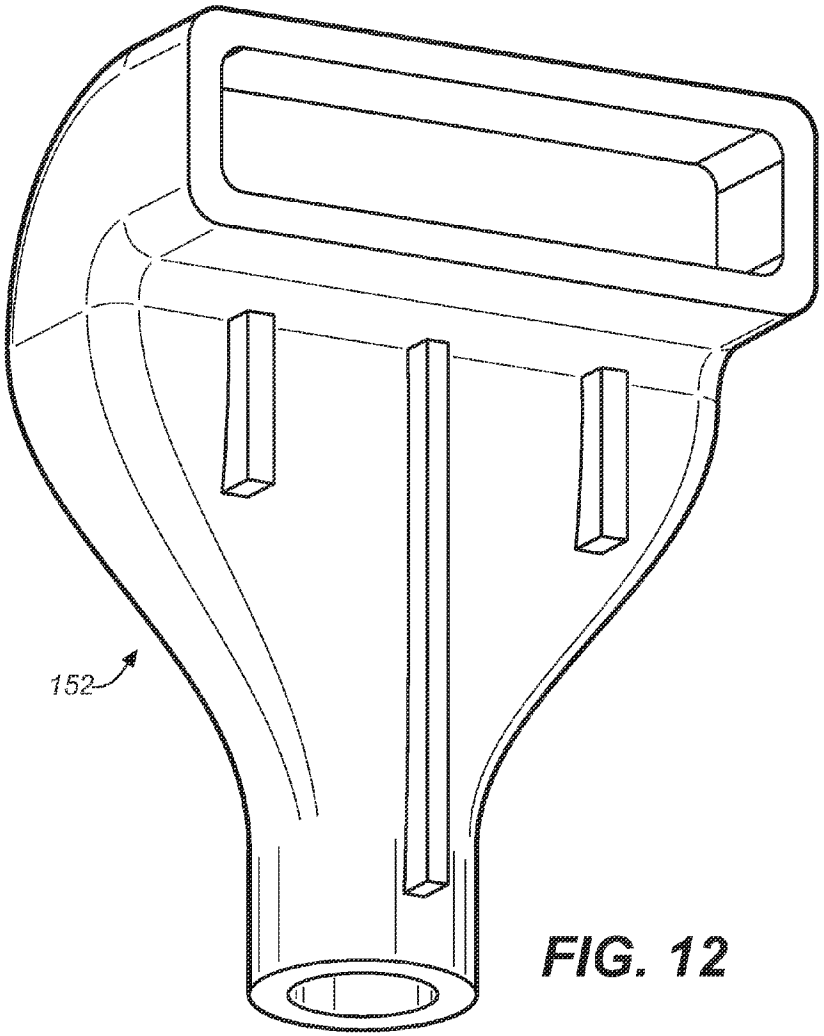
FIGS. 11 and 12 are perspective views of a transition duct of the electrolytic cell shown in FIG. 1 according to an exemplary embodiment of the present disclosure.
Figure 11:
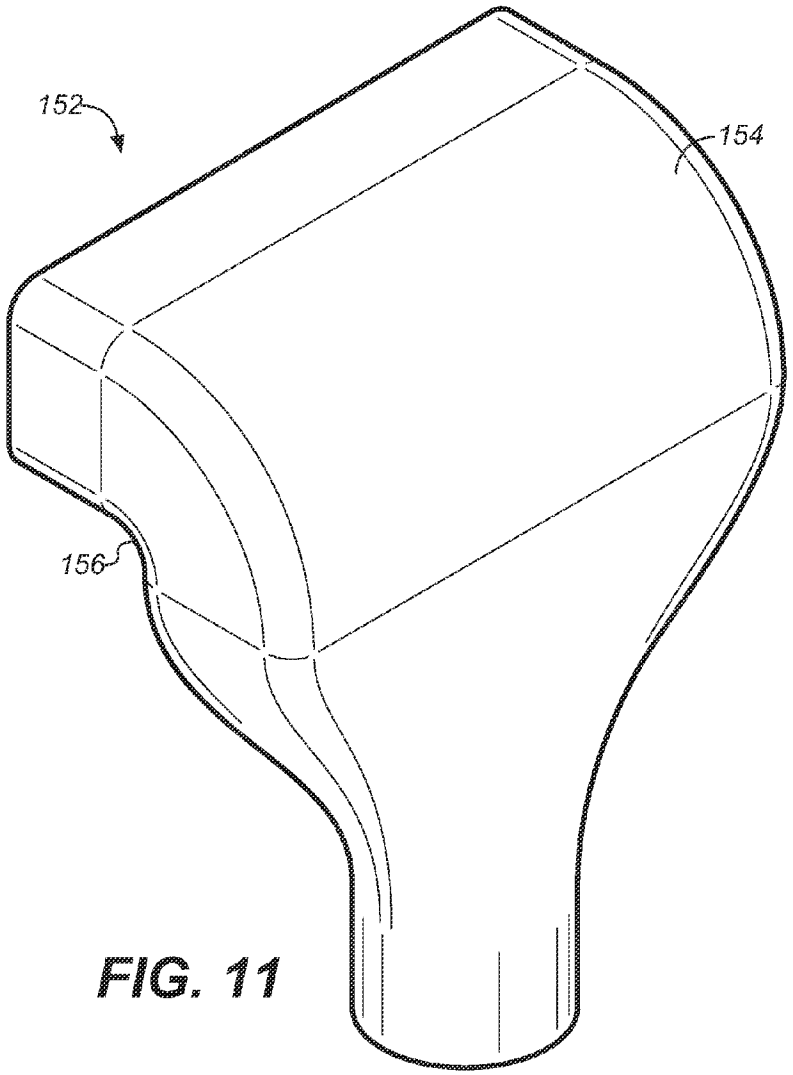
Figure 14:
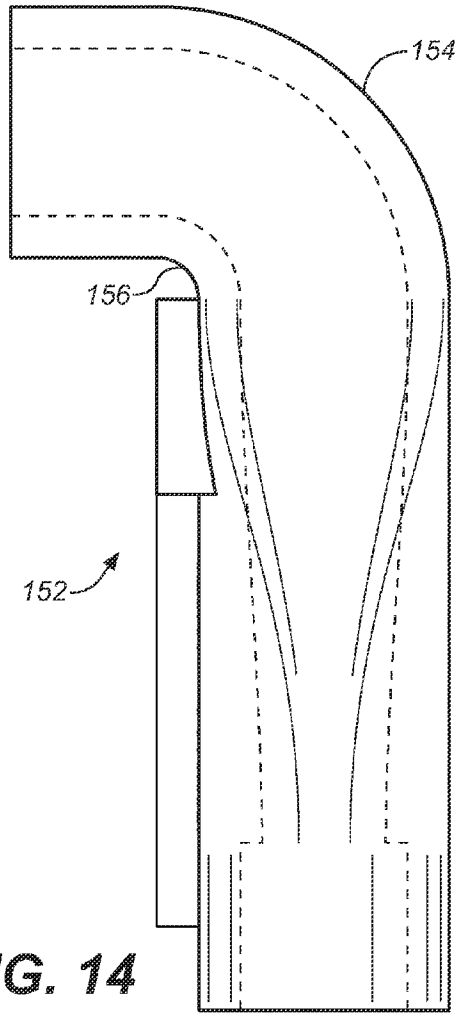
FIGS. 13 and 14 are first and second side elevation views of the transition duct shown in FIGS. 11 and 12.
Figure 13:
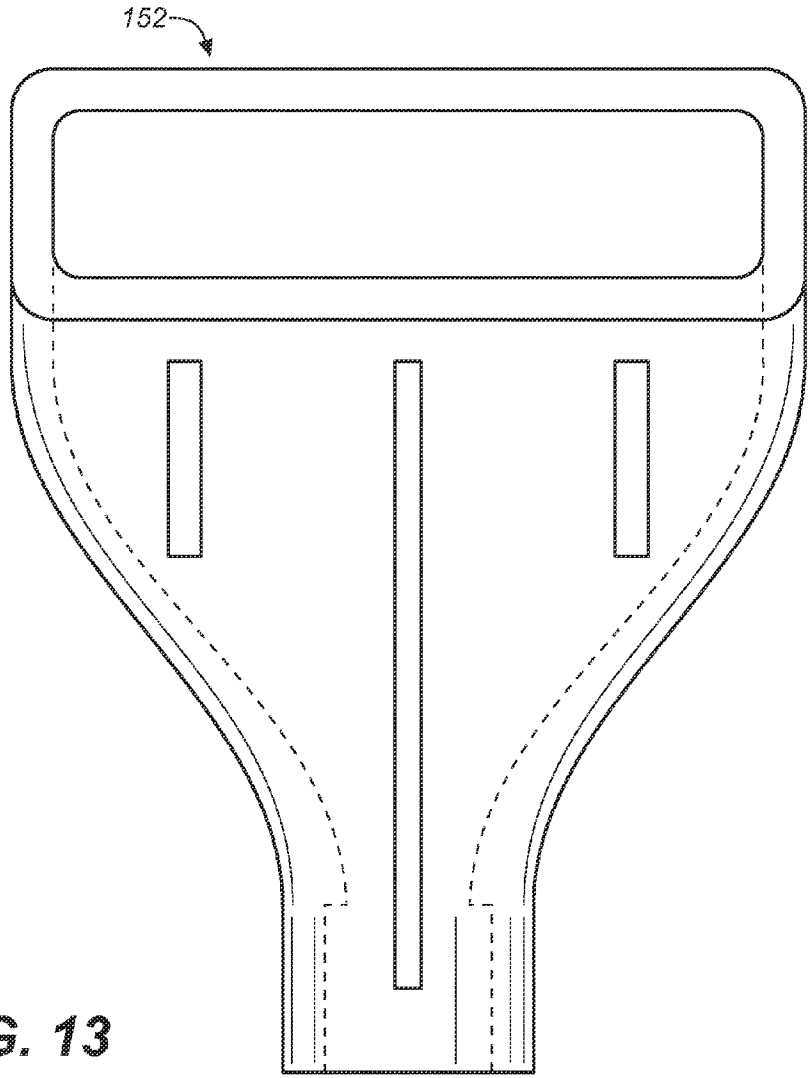

FIGS. 11 and 12 are perspective view of transition duct 152, from opposing viewpoints. FIG. 13 is a bottom plan view of transition duct 152, and FIG. 14 is a side plan view of transition duct 14. In this example, transition duct 152 has larger radiuses of curvature along surfaces 154 and 156 than the example shown in FIGS. 2-9.

Although the present disclosure has been described with reference to one or more embodiments, workers skilled in the art will recognize that changes may be made in form and detail without departing from the scope of the disclosure and/or the issued claims appended hereto. Also while certain embodiments and/or examples have been discussed herein, the scope of the invention is not limited to such embodiments and/or examples. One skilled in the art may implement variations of these embodiments and/or examples that will be covered by one or more issued claims appended hereto.

The invention claimed is:

1. An electrolytic cell comprising:
- a housing comprising a liquid inlet and a liquid outlet;
- an anode and a cathode positioned within the housing and defining a reaction chamber therebetween;
- a liquid flow path, from the liquid inlet to the liquid outlet, which passes through the reaction chamber; and
- a transition duct at the liquid outlet and comprising:
  - a duct inlet, which has a generally rectangular cross-section in a cross-sectional plane that is transverse to a direction of fluid flow through the duct inlet;
  - a duct outlet, which has an oval or elliptical shape; and
  - a transition section along which internal side walls of the transition section converge along the liquid flow path to define a smooth transition from a first cross-sectional area to a second cross-sectional area of the transition duct, wherein the first cross-sectional area is at least two times greater than the second cross sectional area, wherein the transition section has an internal channel that transitions along the transition section from the generally rectangular shape at a location of the first cross-sectional area to the oval or elliptical shape at a location of the second cross-sectional area; and
  - a rectangular curved section extending between the duct inlet and the transition section, along which the liquid flow path through the transition duct transitions from a first direction at the duct inlet to a second direction at the duct outlet, which is perpendicular to the first direction, the rectangular curved section comprising:
    - the generally rectangular cross-section with flat edges and curved corners, perpendicular to the liquid flow path; and
    - curved internal, opposing surfaces along at least one plane that is parallel to the liquid flow path and along which the liquid flow path transitions from the first direction to the second direction.

2. The electrolytic cell of claim 1, wherein the internal side walls of the transition section converge along at least one plane that is parallel to a direction of fluid flow along the liquid flow path.

3. The electrolytic cell of claim 2, wherein the internal side walls of the transition section have a minimum radius of curvature of 5 millimeters along the at least one plane that is parallel to the direction of fluid flow.

4. The electrolytic cell of claim 2, wherein the internal side walls of the transition section are curvilinear in the at least one plane that is parallel to the direction of fluid flow.

5. The electrolytic cell of claim 2, wherein the internal side walls of the transition section are rectilinear in the at least one plane that is parallel to the direction of fluid flow.

6. The electrolytic cell of claim 1, wherein the ratio of the first cross-sectional area to the second cross-sectional area is between 5:1 and 20:1.

7. The electrolytic cell of claim 1, wherein the transition section has a length of at least 20 millimeters and less than 100 millimeters along which the transition section transitions from the first cross-sectional area to the second cross-sectional area.

8. The electrolytic cell of claim 1, wherein the transition section has a funnel shape along at least one plane that is parallel to a direction of fluid flow along the liquid flow path.

9. The electrolytic cell of claim 1, wherein the transition section is conical.

10. The electrolytic cell of claim 1, wherein the transition duct is physically attached to the housing or is fabricated as a single, continuous piece of material with a portion of the housing.

11. An electrolytic cell comprising:
- a housing comprising a liquid inlet and a liquid outlet;
- an anode and a cathode positioned within the housing and defining a reaction chamber therebetween;
- a liquid flow path, from the liquid inlet to the liquid outlet, which passes through the reaction chamber; and
- a transition duct at the liquid outlet and comprising:
  - a duct inlet, which has a generally rectangular cross-section in a cross-sectional plane that it transverse to a direction of fluid flow through the duct inlet;
  - a duct outlet, which has an oval or elliptical shape;
  - a funnel-shaped transition section along which internal side walls of the transition section converge in at least one plane that is parallel to a direction of fluid flow along the liquid flow path to define a smooth transition from a first cross-sectional area to a second cross-sectional area of the transition duct, wherein a ratio of the first cross-sectional area to the second cross sectional area is in a range of 2:1 and 20:1 and the transition section has a length of at least 20 millimeters and less than 100 millimeters, wherein the transition section has a cross-section that transitions along the transition section from the generally rectangular shape at a location of the first cross-sectional area to the oval or elliptical shape at a location of the second cross-sectional area; and a rectangular curved section extending between the duct inlet and the transition section, along which the liquid flow path through the transition duct transitions from a first direction at the duct inlet to a second direction at the duct outlet, which is perpendicular to the first direction, the rectangular curved section comprising:

the generally rectangular cross-section with flat edges and curved corners, perpendicular to the liquid flow path; and curved internal, opposing surfaces along at least one plane that is parallel to the liquid flow path and along which the liquid flow path transitions from the first direction to the second direction.

12. The electrolytic cell of claim 11, wherein the internal side walls of the transition section have a minimum radius of curvature in a direction internal to the transition duct of 5 millimeters along the at least one plane that is parallel to the direction of fluid flow.

13. The electrolytic cell of claim 11, wherein the transition section is conical.

14. The electrolytic cell of claim 11, wherein the transition duct is physically attached to the housing or is fabricated as a single, continuous piece of material with a portion of the housing.

15. The electrolytic cell of claim 1, wherein the generally rectangular cross-section has flat edges and curved corners in the cross-sectional plane that is transverse to a direction of fluid flow through the duct inlet.

16. The electrolytic cell of claim 11, wherein the generally rectangular cross-section has flat edges and curbed corners in the cross-sectional plane that is transverse to a direction of fluid flow through the duct inlet.

* * * * *